United States Patent [19]

Schink et al.

[11] 4,279,269

[45] Jul. 21, 1981

[54] LIQUID FLOW CONTROL MEANS FOR GAS-LIQUID RECEPTACLE

[75] Inventors: Richard R. Schink, Racine; Thomas A. Craig, Menomonee Falls, both of Wis.

[73] Assignee: Milwaukee Cylinder Corporation, Cudahy, Wis.

[21] Appl. No.: 96,381

[22] Filed: Nov. 21, 1979

[51] Int. Cl.[3] ..... F15B 1/04

[52] U.S. Cl. ..... 137/206; 137/207; 137/590

[58] Field of Search ..... 137/207, 590, 592, 202, 137/206, 209

[56] References Cited

U.S. PATENT DOCUMENTS 3,246,670 4/1966 Berninger ..... 137/592

FOREIGN PATENT DOCUMENTS 13204 10/1956 Fed. Rep. of Germany ..... 137/592

*Primary Examiner*—Alan Cohan

*Attorney, Agent, or Firm*—James E. Nilles

[57] ABSTRACT

In a gas-liquid receptacle that holds liquid in contact with pressure gas and has a concentric liquid port in its flat bottom wall, liquid inflow is controlled, to prevent foam generation, by a baffle disc and a screen, both over the liquid port. The baffle disc, which diverts liquid entering the liquid port into decelerating radially outward flow, is at least as big as the liquid port but small enough to be well spaced from the side wall of the receptacle, and it is spaced above the bottom wall by a distance preferably equal to ⅜ of the liquid port diameter. The screen extends entirely across the receptacle and is spaced above the baffle disc by a distance preferably about 50% greater than the distance from the bottom wall to the baffle disc.

5 Claims, 2 Drawing Figures

LIQUID FLOW CONTROL MEANS FOR GAS-LIQUID RECEPTACLE

FIELD OF THE INVENTION

This invention relates to gas-liquid receptacles, such as air-oil tanks, which normally contain a liquid and a pressure gas in direct contact with one another; and the invention is more specifically concerned with flow control means associated with a liquid port in the bottom of such a receptacle, for preventing foam generation when liquid enters the receptacle through the liquid port at high velocity, so that liquid which subsequently flows out through the liquid port will be substantially unmixed with gas.

BACKGROUND OF THE INVENTION

The air-oil tank of an air-oil system exemplifies the type of receptacle to which this invention relates. In an air-oil system, pressure air is fed to a booster by which a relatively large volume of air at a given pressure is applied to the displacement of a smaller volume of hydraulic fluid at a substantially higher pressure. The booster comprises a cylinder and piston mechanism, wherein the air acts on the piston, which moves in a larger-diameter chamber and which has a smaller-diameter rod that is slidable with a close fit in a hydraulic chamber. As the piston is advanced by the pressure air, its rod forces hydraulic fluid out of the hydraulic chamber and into a hydraulic ram. Although the ram may have a rather short stroke, and it is therefore not capable of performing much work, it is capable of exerting a very high force and is thus well adapted for clamping a workpiece and for similar operations where a high force must be exerted and maintained.

An air-oil tank is connected in such a system to provide a source of hydraulic fluid which compensates for any loss of fluid in the hydraulic system. Since the air-oil tank contains pressure air in direct contact with hydraulic fluid, it can provide a source of relatively low pressure hydraulic fluid that can be fed to the ram for returning it to its starting position. The air-oil tank can also serve as an outlet for any air that may have become entrapped in the hydraulic system.

Having in mind that the hydraulic fluid in an air-oil system is subject to very high pressures—which can be on the order of several thousands of pounds per square inch—it will be apparent that for precise and dependable operation of the system the hydraulic fluid that flows out of the air-oil tank must be unmixed with air. Heretofore it has been difficult to satisfy this important requirement in cases where hydraulic fluid was forced into the air-oil tank at any substantially high flow rate, because the liquid then entered the tank in extremely turbulent flow so that it presented a roily surface to air in the tank, mixed with the air, and was thus converted to foam.

Reducing the rate of flow of liquid into the air-oil tank to a value at which foam generation is avoided is impracticable in many installations because pressures and flow rates are fixed by operating requirements and system components and parameters. Usually, baffle arrangements are installed in air-oil tanks to minimize turbulence and churning of incoming liquid, but prior baffles for this purpose have not been fully satisfactory. Those that were reasonably effective in preventing foam generation offered substantial resistance of flow of liquid both into and out of the air-oil tank and thus produced objectionable energy losses and pressure losses that reduced the speed of operation of the system and the forces that could be produced with it.

SUMMARY OF THE INVENTION

The general object of this invention is to provide flow control means for a gas-liquid receptacle of the character described whereby the surface of liquid in the receptacle is maintained relatively smooth and unroiled even when liquid enters the receptacle at high velocity, but whereby little resistance is offered to either the inflow of liquid to the receptacle or the out-flow of liquid therefrom.

It is also an object of this invention to provide very simple and inexpensive liquid flow control means of the character described whereby churning and foam generation is effectively prevented when hydraulic fluid enters a so-called air-oil tank at high flow rates but whereby only negligible resistance is presented to the flow of liquid into and out of the tank, said liquid flow control means being of such character as to be cooperable with air-oil tanks of generally conventional construction and to be suitable for retrofitting to replace heretofore conventional liquid flow baffles in such tanks.

A further object of this invention is to provide an air-oil tank inflow control device of the character described that functions well with low viscosity fluids.

It is a more specific object of the invention to provide means for controlling inflow of liquid to an air-oil tank or a similar gas-liquid receptacle, whereby liquid entering the receptacle at high velocity through a port in its bottom is initially decelerated smoothly but rapidly, and is then subdivided into numerous small and substantially uniform upwardly flowing streams of substantially like velocity, so that the liquid in the receptacle presents a substantially flat, unroiled surface to the air or other pressure gas therein, thus minimizing the tendency for the gas and the liquid to mix and generate foam.

In general, the objects of the invention are achieved in a gas-liquid receptacle which normally contains liquid and pressure gas in contact with one another and which has a flat bottom wall wherein there is a liquid port through which liquid can flow into and out of the receptacle, a top wall wherein there is a gas port through which pressure gas can flow into and out of the receptacle, and a side wall which extends between said top and bottom walls and is substantially concentric with said liquid port. The receptacle is provided with liquid flow control means of this invention whereby foam generation is prevented upon high velocity entry of liquid into the receptacle through the liquid port. That liquid flow control means is characterized by: a baffle plate which is substantially centered over the liquid port and which is substantially parallel to the bottom wall and is spaced thereabove by a height distance substantially smaller than the diameter of the liquid port, preferably about three-eighths of that diameter, and said baffle plate being at least large enough to extend across the entire area of the liquid port but small enough to be substantially spaced from the side wall all around the same. There is a screen in the receptacle, spaced above the baffle plate by a distance at least substantially equal to said height distance, but located below the lowest normally expectable level of liquid in the receptacle; and the screen extends substantially entirely across the receptacle with its edge closely adjacent to the side wall all around the same.

BRIEF DESCRIPTION OF DRAWINGS

In the accompanying drawings, which illustrate what is now regarded as a preferred embodiment of the invention.

DESCRIPTION OF PREFERRED EMBODIMENT OF INVENTION

Figure 1:
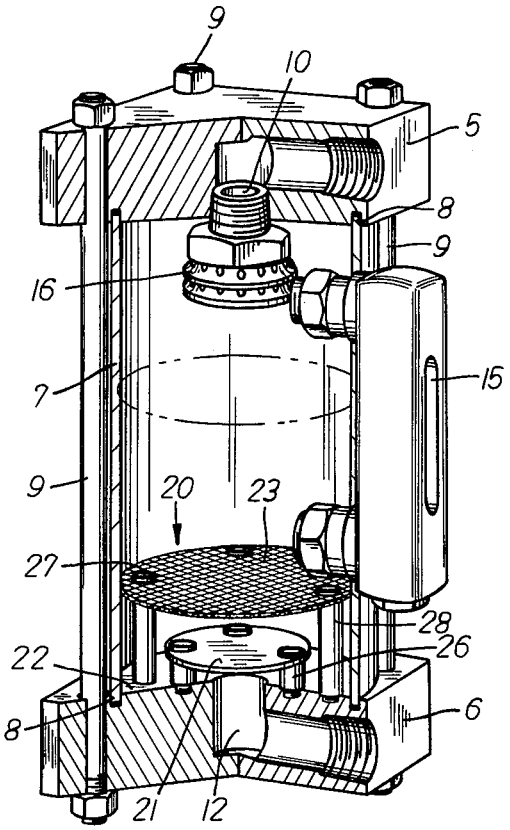
FIG. 1 is a view of gas-liquid receptacle embodying the liquid flow control means of the present invention, the view being substantially in perspective but with portions cut away along the full height of the receptacle to show its interior.
Figure 2:
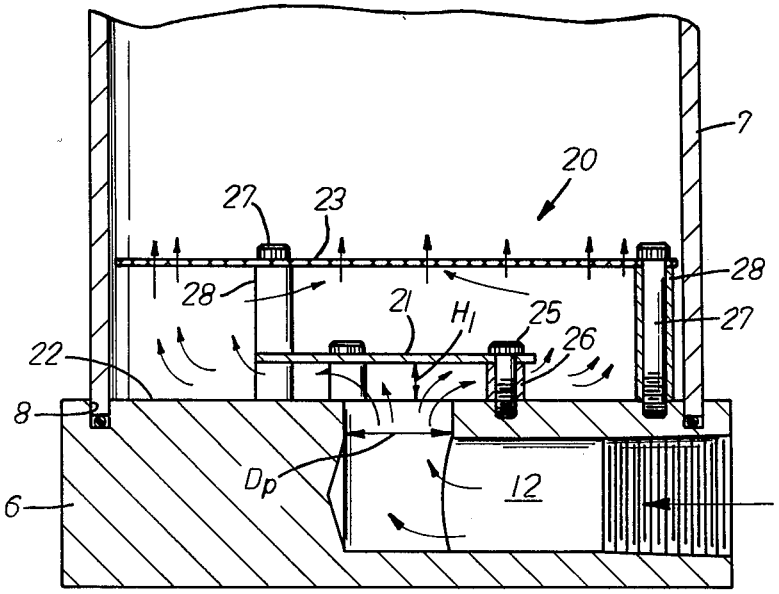
FIG. 2 is a view in vertical section, on a larger scale than FIG. 1, showing the bottom portion of the gas-liquid receptacle and the flow control means associated with the liquid port.

Referring now to the accompanying drawings, the body of an air-oil tank conventionally comprises a top wall element 5, a bottom wall element 6 and a tube 7 that forms the cylindrical side wall of the tank. Each of the wall elements 5 and 6 has an annular groove 8 in which an end portion of the tube 7 is received with a close fit, and tie rods 9, extending through the top and bottom wall elements, secure them to the ends of the tube 7. It will be understood that the ends of the tube 7 are sealed to the top and bottom wall elements with suitable gaskets.

Such a tank exemplifies the gas-liquid receptacles to which the present invention relates, and it will be understood that the invention is not limited to receptacles of the specific tank construction here shown. It might also be noted that the hydraulic fluid used in a so-called air-oil system may be other than oil (for example, an aqueous mixture) and the pressure gas may be other than air.

Because the interior of an air-oil tank is intended to be pressurized, the top and bottom wall elements 5 and 6 are rather thick, and the tank is generally of sturdy construction. Pressure gas flows into and out of the tank through a gas port 10 that is formed in the top wall element 5 and opens downwardly into the receptacle in concentric relation to the cylindrical side wall 7. Hydraulic fluid flows into and out of the receptacle through a liquid port 12 that is formed in the bottom wall element 6 and opens concentrically upwardly into the receptacle. The level of liquid in the receptacle is displayed by means of a sight gage 15 on the tank side wall. To prevent splashed liquid from passing out of the receptacle along with gas, the gas port 10 is provided with a generally conventional baffle or deflector 16 that projects down into the upper portion of the receptacle.

The flow control means of the present invention, which is designated generally by 20, is associated with the liquid port 12 and is located in the bottom portion of the receptacle. It comprises an imperforate disc-like baffle 21, which is spaced above the bottom surface 22 of the receptacle, and a disc-like screen 23, which is spaced above the baffle 21. Both the baffle 21 and the screen 23 are flat and parallel to the bottom wall surface 22. The baffle 21 extends entirely across the liquid port 12, and while it may be somewhat larger than the liquid port, its edges must be substantially spaced from the side wall 7 all around the same. The screen 23, however, should extend entirely across the receptacle, with no more than a reasonable clearance space between its edge and the side wall, to facilitate its installation.

The baffle 21 is supported in any suitable manner. As shown, it is held in place by means of three upright bolts 25 that are threaded into the bottom wall element 6. Each bolt 25 is surrounded by a spacer sleeve 26, and the baffle 21 is confined between the upper end of the spacer sleeve 26 and the head of the bolt. The bolts pass through the baffle near its edge and are spaced at equal distances from one another and from the axis of the receptacle. The screen is supported in a like manner by three upright bolts 27 and their cooperating spacer sleeves 28.

Liquid flowing into the receptacle through the liquid port 12 is deflected by the baffle 12 into radially outward flow. As it moves away from the axis of the receptacle, the liquid is in effect flowing into a passage that has steadily increasing area, and accordingly the liquid is smoothly and steadily decelerated from the high velocity at which it normally leaves the liquid port. Passing out from under the edge of the baffle 21, the liquid is deflected into upward flow by the side wall 7 of the receptacle, which cooperates with the edge of the baffle to define an axially short annular passage around the baffle. It will be observed that the two changes in flow direction of the liquid—first to radially outward flow beneath the baffle and then to upward flow past it—take place well below the surface level of the liquid so that such turbulence as results from these diversions has little or no tendency to roil the surface of the liquid and generate foam.

The deceleration of the incoming liquid continues as it moves up past the edge of the baffle 21 and enters the portion of the receptacle above that baffle. In the absence of the screen 23 the liquid would have a tendency to flow upward at different velocities in different zones across the receptacle. The screen 23 overcomes this tendency. The screen 23 breaks up the upward flow of liquid into numerous small streams conforming to the screen openings. Since the liquid tends to follow paths which impose the least resistance to its upward flow, the screen 23 brings about an energy redistribution in the flowing liquid such that the numerous small streams that flow up through it are of substantially uniform velocity. The result is that the surface of the liquid in the receptacle remains fairly level and smooth, notwithstanding the high velocity at which the liquid enters the receptacle and, consequently there is little tendency for the liquid to mix with the gas in the receptacle.

As mentioned above, the diameter of the baffle disc 21 should be at least equal to the diameter of the liquid port 12 so that all portions of the incoming liquid stream are diverted into radial flow. The diameter of the baffle can be substantially larger than that of the liquid port 12, provided sufficient spacing is left between the edge of the baffle and the receptacle side wall 7 for unaccelerated upward flow of liquid past the baffle. It is preferred that the baffle 21 be just sufficiently larger than the liquid port 12 to accommodate adequate mounting means for the baffle.

The minimum height of the baffle 21 above the bottom surface 22 of the receptacle is such that the entry to the passage between the baffle and that surface 22 has an area no smaller than that of the port itself. Thus, if the diameter of the liquid port 12 is designated by Dp and the height of the baffle 21 above the surface 22 is designated by $H_1$, then $$\pi Dp\ H_{1\ min} = \pi(\tfrac{1}{2}Dp)^2$$

or $$H_{1\ min} = \tfrac{1}{4}Dp.$$

The preferred height of the baffle 21 above the surface 22 is about 50% greater than this minimum, that is the baffle 21 is preferably at a distance above the surface 22 that is equal to about $\frac{3}{8}$ of the diameter of the liquid port 12.

The screen 23 is an ordinary wire mesh screen. A 35-mesh screen has been found satisfactory for aqueous hydraulic fluids and a 15- to 20-mesh screen for oil-type hydraulic fluids. As mentioned above, the screen 23 should extend substantially entirely across the receptacle so that substantially all liquid flowing upward from the liquid port 12 is constrained to pass through it. The screen 23 should be at such an elevation that it is below the lowest level to which the receptacle is normally filled with liquid.

For satisfactory results the screen 23 should be spaced above the baffle 21 by a distance equal to no less than one-quarter of the diameter of the liquid port 12. However, the effectiveness of the screen 23 increases as the distance between it and the baffle 21 is increased above this value. Very satisfactory performance was obtained with the screen 23 spaced above the baffle 21 by a distance equal to three-quarters of the diameter of the liquid port 12. From the foregoing description taken with the accompanying drawings it will be apparent that this invention provides very simple and inexpensive liquid flow control means for a gas-liquid receptacle such as an air-oil tank, whereby little resistance is presented to flow of liquid into and out of the receptacle but mixing of liquid with pressure gas is prevented to ensure stable and reliable operation of a system in which the receptacle is connected.

What is claimed as the invention is:

1. In a gas-liquid receptacle which normally contains liquid and pressure gas in contact with one another, said receptacle having a substantially flat bottom wall wherein there is a liquid port through which liquid can flow into and out of the receptacle, a top wall wherein there is a gas port through which pressure gas can flow into and out of the receptacle, and a side wall which extends between said top and bottom walls and is substantially coaxial with said liquid port, liquid flow control means for preventing foam generation upon high velocity entry of liquid into the receptacle through said liquid port, said liquid flow control means comprising:

A. a baffle plate substantially centered over said liquid port, said baffle plate (1) being substantially parallel to said bottom wall and spaced thereabove by a height distance substantially smaller than the diameter of said liquid port, and (2) being at least large enough to extend across the entire area of said liquid port but small enough to be substantially spaced from said side wall all around the same; and B. a screen in said receptacle (1) spaced above said baffle plate by a distance at least substantially equal to said height distance but being below the lowest normally expectable level of liquid in the receptacle, and (2) extending substantially entirely across the receptacle with its edge closely adjacent to said side wall all around the same.

2. The gas-liquid receptacle of claim 1, further characterized by:

said height distance being at least equal to one-quarter of the diameter of the liquid port.

3. The gas-liquid receptacle of claim 1, further characterized by:

(1) said height distance being substantially equal to three-eighths of the diameter of the liquid port, and (2) said screen being spaced above said baffle plate by a distance substantially equal to three-fourths of the diameter of the liquid port.

4. In a gas-liquid receptacle which normally contains liquid and pressure gas in contact with one another, said receptacle having a substantially flat bottom wall wherein there is a liquid port through which liquid can flow into and out of the receptacle, a top wall wherein there is a gas port through which pressure gas can flow into and out of the receptacle, and a side wall which extends between said top and bottom walls and is substantially coaxial with said liquid port, liquid flow control means for preventing foam generation upon high velocity entry of liquid into the receptacle through said liquid port, said liquid flow control means comprising:

A. deflector means for decelerating liquid as it flows from the liquid port into the bottom of the receptacle, said deflector means comprising a disc-like baffle which extends completely across the liquid port, substantially normal to the axis thereof, (1) said baffle being spaced above said bottom wall to cooperate therewith in defining a passage which extends radially in all directions from said liquid port and into which liquid issuing from the liquid port is diverted for radially outward flow, and (2) said baffle being concentric to said side wall and having its edge substantially spaced therefrom so that liquid passing radially beyond the baffle is further diverted by said side wall into substantially upward flow past the baffle; and B. a screen spaced above the baffle and extending substantially entirely across the receptacle at a level below the normally expectable lowest level of liquid in the tank for forming upwardly flowing liquid that has passed the baffle into numerous small streams of substantially uniform velocity so that the surface of the liquid is substantially smooth and level.

5. The gas-liquid receptacle of claim 4, further characterized by:

(1) the height distance between said baffle and the bottom wall of the receptacle being equal to not less than one-fourth of the diameter of the liquid port and not substantially greater than half the diameter of the liquid port; and (2) the distance between the baffle and said screen being no less than said height distance and not substantially greater than twice said height distance.

* * * * *